US006583566B1

(12) United States Patent
Jin et al.

(10) Patent No.: US 6,583,566 B1
(45) **Date of Patent: *Jun. 24, 2003**

(54) LOW WATTAGE FLUORESCENT LAMP HAVING IMPROVED PHOSPHOR LAYER

(75) Inventors: Feng Jin, Sagamore Hills, OH (US); Thomas F. Soules, Richmond Heights, OH (US)

(73) Assignee: General Electric Company, Schenectady, NY (US)

( * ) Notice: Subject to any disclaimer, the term of this patent is extended or adjusted under 35 U.S.C. 154(b) by 57 days.

This patent is subject to a terminal disclaimer.

(21) Appl. No.: 09/699,819

(22) Filed: Oct. 30, 2000

Related U.S. Application Data

(63) Continuation-in-part of application No. 09/697,883, filed on Oct. 27, 2000.

(51) Int. Cl.[7] ..... H01J 17/20; H01J 61/12

(52) U.S. Cl. ..... 313/637; 313/643; 313/639; 313/485; 313/484; 313/489; 313/635

(58) Field of Search ..... 313/483, 484, 313/485, 486, 489, 637, 638, 639, 640, 572, 576

(56) References Cited

U.S. PATENT DOCUMENTS

| | | | | |
|---|---|---|---|---|
| 2,714,684 A | | 8/1955 | Meister et al. | 313/484 |
| 3,780,329 A | | 12/1973 | Otsuka et al. | 313/485 |
| 3,780,330 A | | 12/1973 | Otsuka et al. | 313/484 |
| 4,338,544 A | * | 7/1982 | Komiya et al. | 313/489 |
| 4,409,521 A | * | 10/1983 | Roberts | 313/493 |
| 4,559,470 A | * | 12/1985 | Murakami et al. | 313/485 |
| 4,583,026 A | | 4/1986 | Kajiwara et al. | 313/642 |
| 4,890,033 A | * | 12/1989 | Ichinomiya et al. | 313/485 |
| 4,988,914 A | * | 1/1991 | Rutfield et al. | 313/486 |
| 5,008,789 A | | 4/1991 | Arai et al. | 313/486 |
| 5,051,653 A | | 9/1991 | DeBoer et al. | 313/489 |
| 5,309,069 A | * | 5/1994 | Sigai et al. | 313/486 |
| 5,602,444 A | | 2/1997 | Jansma | 313/489 |
| 5,714,836 A | | 2/1998 | Hunt et al. | 313/487 |
| 5,838,100 A | | 11/1998 | Jansma | 313/485 |
| 5,898,265 A | | 4/1999 | Woodward et al. | 313/486 |
| 6,400,097 B1 | * | 6/2002 | Jin et al. | 313/486 |

FOREIGN PATENT DOCUMENTS

EP 0 131 965 A2 7/1984

OTHER PUBLICATIONS

W. Elenbass, "Fluorescent Lamps and Lighting", Phillips Technical Library, Cleaver–Hume Press LTD, 2nd ed., 1962, pp 128–141.*

* cited by examiner

*Primary Examiner*—Ashok Patel
*Assistant Examiner*—Mariceli Santiago
(74) *Attorney, Agent, or Firm*—Pearne & Gordon LLP

(57) ABSTRACT

A low-wattage mercury vapor discharge lamp is provided for use with existing 110V high frequency electronic ballasts. The lamp has a discharge sustaining fill of mercury and an inert gas mixture of krypton and argon that does not require a starting aid. The phosphor layer has a coating weight of 2.0–3.9 mg/cm$^2$.

19 Claims, 1 Drawing Sheet

LOW WATTAGE FLUORESCENT LAMP HAVING IMPROVED PHOSPHOR LAYER

This application is a continuation-in-part of U.S. patent application Ser. No. 09/697,883, filed Oct. 27, 2000.

BACKGROUND OF THE INVENTION

1. Field of the Invention

The present invention relates generally to a fluorescent lamp, and more particularly to a low wattage fluorescent lamp adapted to function with high frequency electronic ballasts already present in the marketplace.

2. Description of Related Art

T8 fluorescent lamps have become quite popular in North American markets, and have largely supplanted the previous generation T12 fluorescent lamps due to their inherent higher efficiency. A typical North American 4-foot T8 fluorescent lamp using the known three component rare earth phosphor blends operates on the IES reference circuit at 32.5 watts (W) and produces 2850 lumens or about 88 lumens/watt. On high frequency commercial electronic ballasts, efficiencies are significantly higher, near 100 lumens/watt.

It is desirable to improve the energy efficiency of T8 fluorescent lamps to consume less energy. There currently exist no low-wattage lamps that deliver the same lumen output as standard lamps. Because lighting applications employing T8 lamps account for a significant portion of total energy consumption in North America, an improved energy efficient lamp will significantly reduce total energy consumption. Reduced energy consumption translates into cost savings to the consumer as well as reduced environmental impact associated with excess energy production necessary to meet current needs.

One way to reduce energy costs for this lamp would be to replace current installed electronic ballasts with ballasts which operate the lamp at a lower current. However, simply lowering the lamp current will reduce light output and in certain lighting applications light levels cannot or are not desired to be reduced. A major problem associated with producing such an energy efficient system is that current lighting installations employ relatively expensive high-frequency electronic ballasts having long lives. Consequently, a low-wattage lamp must either be compatible with existing electronic ballasts, or require the replacement of such ballasts at consumer expense. Replacing the electronic ballasts would offset the energy cost savings, and therefore would be a disincentive for consumers.

Consequently, there is a need for a low-wattage T8 fluorescent lamp having equivalent lumen output compared with standard T8 fluorescent lamps, that is adapted to function with currently emplaced high-frequency electronic ballasts.

SUMMARY OF THE INVENTION

A low pressure mercury vapor discharge lamp is provided having a light-transmissive glass envelope with an inner surface, means for providing a discharge, an ultraviolet reflecting barrier layer of alumina particles coated on or adjacent the inner surface of the glass envelope, a phosphor layer coated on the barrier layer, and a discharge-sustaining fill of mercury and inert gas sealed inside the envelope. The inert gas is a mixture of argon and krypton, with krypton being 10–40 volume percent of the mixture. The total pressure of the inert gas is 1–4 torr. The lamp has a lumen efficiency of at least 80 lumens/watt.

DETAILED DESCRIPTION OF THE PREFERRED EMBODIMENTS

Figure 1:
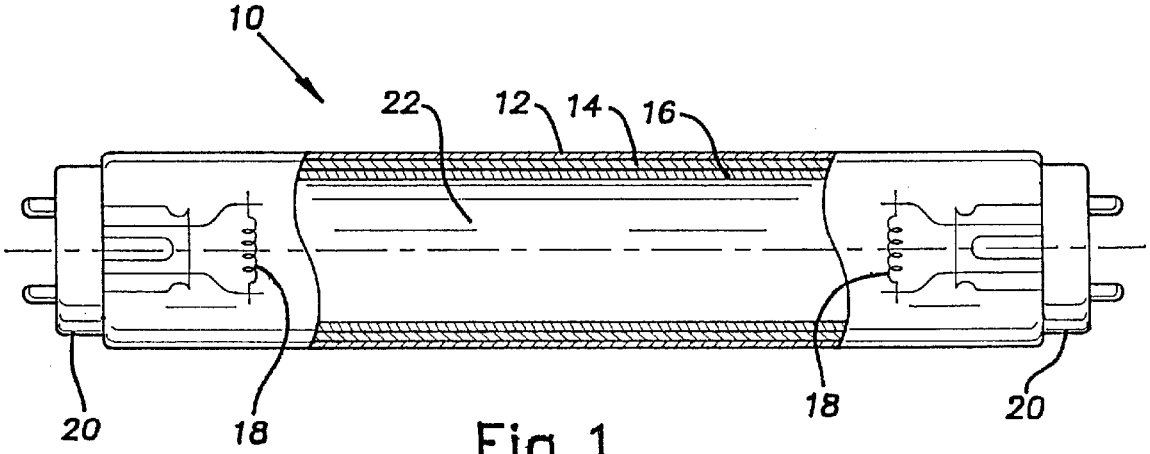
FIG. 1 shows a representative low pressure mercury vapor discharge lamp according to the present invention.

In the description that follows, and in the appended claims, when a preferred range, such as 5 to 25 (or 5–25), is given, this means preferably at least 5, and separately and independently, preferably not more than 25. When a range is given in terms of a weight percent (wt. %) for a single component of a composite mixture, this means that the single component is present by weight in the composite mixture in the stated proportion relative to the sum total weight of all components of the composite mixture.

As used herein, "electronic ballast" means a high frequency electronic ballast as known in the art, comprising a light weight solid state electronic circuit adapted to convert a 110V 60 Hz AC input signal, into a high frequency AC output signal in the range of 20–150, more preferably 20–100, more preferably 20–80, more preferably 20–50, more preferably 25–40, kHz, and having an output voltage in the range of 150–1000V. The electronic ballast preferably is an instant-start ballast and is adapted to operate a T8 fluorescent lamp as known in the art. Less preferably, the ballast can be a rapid-start ballast as known in the art.

Also as used herein, a "T8 fluorescent lamp" is a fluorescent lamp as commonly known in the art, preferably linear, preferably 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet in length. Alternatively, a T8 fluorescent lamp may be nonlinear, for example circular or otherwise curvilinear, in shape.

A "T12 fluorescent lamp" is a linear fluorescent lamp as commonly known in the art having a nominal outer diameter of 1.5 inches and a similar set of lengths as the T8 lamps.

As used herein and in the claims, wattages are as measured on the standard IES 60 Hz rapid start reference circuit known in the art.

FIG. 1 shows a low pressure mercury vapor discharge fluorescent lamp 10 according to the present invention. The fluorescent lamp 10 has a light-transmissive glass tube or envelope 12 which has a circular cross-section. The glass envelope 12 preferably has an inner diameter of 2.37 cm, and a length of 118 cm, though the glass envelope may optionally have a different length. The inner surface of the glass envelope 12 is coated with an ultraviolet (UV) reflecting barrier layer 14, preferably comprising a mixture of alpha- and gamma-alumina particles. Preferably, barrier layer 14 is in direct contact with the inner surface of glass envelope 12. The inner surface of the barrier layer 14 is coated with a phosphor layer 16. Phosphor layer 16 is preferably a rare earth phosphor layer, such as a rare earth triphosphor layer. Optionally phosphor layer 16 can be a halophosphate phosphor layer, which would produce lower lumens but still achieve the lower wattage.

The lamp is hermetically sealed by bases 20 attached at both ends, and a pair of spaced electrode structures 18 (which are means for providing a discharge) are respectively mounted on the bases 20. A discharge-sustaining fill 22 of mercury and an inert gas is sealed inside the glass tube. The inert gas is preferably a mixture of argon and krypton according to the present invention. The inert gas and a small quantity of mercury provide the low vapor pressure manner of operation.

The phosphor layer 16 preferably comprises a mixture of red, green and blue emitting rare earth phosphors, preferably a triphosphor mixture. The red emitting phosphor is preferably yttrium oxide activated with europium ($Eu^{3+}$), commonly abbreviated YEO.

The green emitting phosphor is preferably lanthanum phosphate activated with cerium ($Ce^{3+}$) and terbium ($Tb^{3+}$), commonly abbreviated LAP. Less preferably the green emitting phosphor can be cerium, magnesium aluminate activated with terbium ($Tb^{3+}$), commonly abbreviated CAT, less preferably gadolinium, magnesium pentaborate activated with cerium ($Ce^{3+}$) and terbium ($Tb^{3+}$), commonly abbreviated CBT, less preferably any other suitable green emitting phosphor as known in the art.

The blue emitting phosphor is preferably calcium, strontium, barium chlorophosphate activated with europium ($Eu^{2+}$), less preferably barium, magnesium aluminate activated with europium ($Eu^{2+}$), less preferably any other suitable blue emitting phosphor known in the art. The three triphosphor components are combined on a weight percent basis, as known in the art, to obtain preselected lamp colors. Typical lamp colors include those having correlated color temperatures (CCT) of nominally 3000 K, nominally 3500 K, nominally 4100 K, nominally 5000 K, and nominally 6500 K, though the triphosphors may be beneficially combined in relative wt. % ratios to yield a lamp having other predetermined color temperatures. The color temperatures are preferably at least or not more than those set forth above, or preferably plus or minus 50 K, 100 K, 150 K or 200 K. The lamp colors preferably lie within two, three or four MPCD steps of the standard CIE colors corresponding to the above CCTs.

In a less preferred embodiment, rare earth phosphor blends comprising other numbers of rare earth phosphors, such as systems with 4 or 5 rare earth phosphors, may be used in the phosphor layer 16.

The general coating structure is disclosed in U.S. Pat. No. 5,602,444. This coating structure is known in the art. As disclosed in the '444 patent, the UV-reflective barrier layer 14 comprises a blend of gamma- and alpha-alumina particles coated on the inner surface of the glass envelope 12, and a phosphor layer 16 coated on the inner surface of the barrier layer 14.

The phosphor layer 16 of the present invention is disposed on the inner surface of the UV-reflective barrier layer 14 and has a coating weight of preferably 2.0–3.9, more preferably 2.2–3.5, more preferably 2.4–3.3, more preferably 2.5–3.2, more preferably 2.6–3.1, more preferably 2.8–3.0, more preferably 2.9, mg/cm$^2$. A standard 4 foot T8 lamp has an inner surface area of approximately 900 cm$^2$. Accordingly, to compute the phosphor coating weight per lamp, multiply the coating weight above by this surface area. This represents a significant increase in coating weight over certain prior art, e.g. U.S. Pat. Nos. 5,008,789, 5,051,653, and 5,602,444, where typical coating weights of approximately 1.3 and 1.9 mg/cm$^2$ have been employed, for example, in General Electric Company's well known STARCOAT (Trademark) SP and SPX type lamps respectively. Low coating weights as taught in the above patents have been desirable until now as a cost-saving measure because lamp cost is a strong function of coating weight. However, a T8 fluorescent lamp according to the present invention, though nominally more expensive, consumes less energy to produce the same lumens when used in conjunction with existing electronic ballasts. Increased phosphor coating weight, in conjunction with the alumina barrier layer 14 as described above, results in greater than 99% absorption of all the UV radiation generated by the discharge, and subsequent conversion into visible light. This results in about a 3% increase in efficiency over existing high performance General Electric SPX lamps which are generally known in the art. Hence, fluorescent lamps of the present invention consume less energy to produce the same lumens due to improved lamp efficiency.

The fill gas 22 preferably comprises a mixture of argon and krypton. The fill gas 22 for standard T8 fluorescent lamps is argon. Fill gas mixtures of argon and krypton are generally known in the art for certain lamps. Such mixtures, for example, commonly have been used in low-wattage prior generation T12 lamps. The addition of krypton reduces energy consumption in fluorescent lamps because krypton, having a higher atomic weight than argon, results in lower electron scattering and heat conduction losses per unit length of the discharge. However, a major disadvantage of krypton is that it suppresses Penning effect ionization, thereby making the lamp difficult to start on a standard 110V ballast. A common starting aid is a film of semi-conducting tin oxide doped with fluorine or antimony applied to the inner surface of the glass envelope 12 via spray pyrolysis. During starting, the discharge capacitively couples to the coating and current passes along the wall until the discharge itself becomes conducting. However, such a film requires an additional coating step and is difficult to apply correctly, thus contributing to increased manufacturing time and cost. Additionally, the starting aid film reduces lumen output by 1–2.5 percent. Hence, in lamps requiring a starting aid to counter the effect of krypton in the fill gas 22, energy cost savings is at least partially offset by reduced lumen output and the added cost of the starting aid. Previous generation low-wattage T12 lamps typically contain 75–90 percent krypton in the fill gas, with the balance argon. Such a high ratio of krypton contributes significantly to the difficulty in starting fluorescent lamps.

The fluorescent lamp of the present invention employs a fill gas 22 comprising krypton and argon, with krypton being preferably 10–40, more preferably 15–35, more preferably 20–30, more preferably 22–28, more preferably 23–27, more preferably 25, vol. % of the fill gas 22, balance argon. The total fill gas pressure is preferably 1–4, more preferably 1.5–3, more preferably 1.6–2.6, more preferably 1.8–2.4, more preferably 1.9–2.4, more preferably 1.9–2.3, more preferably about 2.2, torr at room temperature (~25° C.). A lamp having a fill gas composition and total pressure as described above reduces power consumption, yet requires no starting aid when used in T8 lamps in conjunction with an electronic ballast.

A lamp comprising 25 volume percent (vol. %) krypton requires a starting voltage of approximately 480V, whereas a lamp comprising 80 vol. % krypton requires a starting voltage of approximately 520V. T8 fluorescent lamps according to the present invention have been tested with several instant-start electronic ballasts common in the marketplace. A list of those ballasts tested is provided in Table 1 below.

TABLE 1

List of Common Instant-Start Electronic Ballasts Tested With Low-Wattage T8 Lamps

| Manufacturer | Model |
|---|---|
| Power Lighting | E232P120L |
| Power Lighting | E232PI120G01 |
| Magnetek | B232I120L |
| Magnetek | B232I120RH |
| Advance | REL 2P32-SC |
| Advance | REL 2P32-RH-TP |
| Advance | RCN 2P32-LW |
| Advance | RCE 2P32 |
| Motorola | M2-IL-T8-GP-D-120 |
| Motorola | M2-IN-T8-D-120 |
| Howard Industries | E2-32-IS-120 |
| Howard Industries | EP2-32IS-120-130 |
| Howard Industries | EL2-32IS-120 |

Satisfactory starting of the invented lamps was achieved on all of the above 110V electronic ballasts using the combination of argon-krypton ratio and total fill gas pressure as described above. No starting aid was required to achieve satisfactory starting with any of the tested ballasts. Consequently, a lamp according to the present invention can be employed in conjunction with, and is adapted to be effectively electrically coupled to, electronic ballasts already present in the marketplace, meaning that consumers can immediately begin using low-wattage fluorescent lamps in existing fluorescent lighting fixtures.

The invention will be understood, and particular aspects of the invention further described, in conjunction with the following example.

EXAMPLE 1

Low-wattage 4-foot T8 lamps according to the present invention were tested on the standard IES 60 Hz rapid start reference circuit, and the average performance of 20 such lamps was compared with the average performance of 20 standard 4-foot T8 lamps on the same circuit. The results are shown below in Table 2.

TABLE 2

Comparison of Low-Wattage Fluorescent Lamps and Standard Fluorescent Lamps

| Lamp | Nominal Color Temp (K.) | Gas Composition (vol. %) | Total Fill Gas Pres. (torr) | Coating Weight (mg/cm$^2$) | Power Consumption (Watts) [110 V 60 Hz AC Ballast] | 100-Hour Lumens |
|---|---|---|---|---|---|---|
| Standard T8 | 3500 | 100% Ar | 2.5 | 1.9 | 32.6 | 2855 |
| Low-wattage T8 | 3500 | 75% Ar<br>25% Kr | 2.08 | 2.9 | 30.9 | 2930 |
| Improvement | | | | | 5.2% | |

As can be seen in Table 2, the low-wattage T8 lamp consumed about 5% less power. The standard T8 lamp yielded about 88 lumens/watt while the improved low-wattage T8 lamp yielded 95 lumens/watt. While the invented lamps resulted in a decrease in power consumption of about 5% when used in the standard reference circuit, it has been observed that the same lamps result in a decrease in power consumption of 5–8% when operated on typical commercial ballasts such as those listed in Table 1. The invented lamp preferably (1) consumes at least 1, 2, 3, 4, 5, 6, 7, 8, 9, 10, 11, 12 or 13 percent less wattage, and (2) yields at least 1, 2, 3, 4, 5, 6, 7 or 8 percent more lumens/watt than the standard T8 lamp mentioned above. The same percentage reductions in wattages and increases in efficiency or efficacy (lumens/watt) are achieved in other standard T8 lamps at the different lengths and at the different color temperatures mentioned earlier in this application.

The invented low-wattage 4-foot linear T8 lamp preferably consumes not more than 32.2, 31.8, 31.5, 31.2, 30.9, 30.5, 30.2, 29.9, 29.6, 29.2, 28.9, 28.6 or 28.3 watts.

A T8 fluorescent lamp according to the present invention will have nominally identical color rendering index (CRI) characteristics compared to equivalent standard T8 lamps. Hence, the invented lamps can be employed in virtually all lighting applications where current T8 lamps are used, their CRI characteristics being similarly tunable through proper selection of triphosphors or halophosphate phosphors or other phosphors suitable for general illumination. A lamp of the present invention preferably has a CRI of at least 50, preferably at least 60, preferably at least 70, preferably at least 75, preferably at least 80. The invented lamp preferably has an efficacy of at least 80, preferably at least 82, preferably at least 84, preferably at least 86, preferably at least 88, preferably at least 90, preferably at least 92, preferably at least 94, preferably at least 96, lumens/watt (as measured on the IES reference circuit mentioned above). The invented lamp preferably has a lumen output of at least 2700, 2750, 2800 or 2850, lumens, measured at 100 hours (100-hour lumens).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A low pressure mercury vapor discharge lamp comprising a light-transmissive glass envelope having an inner surface, means for providing a discharge, an ultraviolet reflecting barrier layer comprising alumina particles coated adjacent said inner surface of said glass envelope, a phosphor layer coated on said barrier layer, and a discharge-sustaining fill of mercury and inert gas sealed inside said envelope, said phosphor layer having a coating weight of 2.0–3.9 mg/cm$^2$, said inert gas comprising a mixture of argon and krypton wherein krypton is 10–40 volume percent of said mixture and the total pressure of said inert gas inside said envelope is 1–4 torr, said lamp having a lumen efficiency of at least 80 lumens/watt.

2. A lamp according to claim 1, wherein said phosphor layer comprises a blended triphosphor system of red, green, and blue color-emitting rare earth phosphors.

3. A lamp according to claim 2, said red color-emitting phosphor being yttrium oxide activated with europium ($Eu^{3+}$), said green color-emitting phosphor being lanthanum phosphate activated with cerium ($Ce^{3+}$) and terbium ($Tb^{3+}$), and said blue color-emitting phosphor being calcium, strontium, barium chlorophosphate activated with europium ($Eu^{2+}$).

4. A lamp according to claim 2, said lamp having a correlated color temperature selected from the group consisting of nominally 3000 K, nominally 3500 K, nominally 4100 K, nominally 5000 K, and nominally 6500 K.

5. A lamp according to claim 1, wherein said lamp operates at a power of not more than 32.2 watts.

6. A lamp according to claim 1, wherein said lamp has an output of at least 2800 lumens.

7. A lamp according to claim 1, wherein said lamp has a lumen efficiency of at least 90 lumens/watt.

8. A lamp according to claim 1, wherein said phosphor layer has a coating weight of 2.2–3.5 mg/cm$^2$.

9. A lamp according to claim 1, wherein said phosphor layer has a coating weight of 2.5–3.2 mg/cm$^2$.

10. A lamp according to claim 1, wherein krypton is 15–35 volume percent of said inert gas mixture.

11. A lamp according to claim 1, wherein krypton is 22–28 volume percent of said inert gas mixture.

12. A lamp according to claim 1, wherein said inert gas sealed inside said envelope has a total pressure of 1.8–2.4 torr.

13. A lamp according to claim 1, said lamp having a CRI of at least 50.

14. A lamp according to claim 1, said lamp having a CRI of at least 75.

15. A lamp according to claim 1, wherein said lamp is a T8 fluorescent lamp.

16. A lamp according to claim 1, wherein said lamp is a 4-foot T8 fluorescent lamp.

17. A lamp according to claim 1, wherein said lamp operates at a power of not more than 30.9 watts.

18. A lamp according to claim 1, said phosphor layer absorbing greater than 99% of all UV radiation generated by said discharge.

19. A lamp according to claim 1, said lamp excluding a starting aid.

* * * * *